US005503476A

United States Patent [19]

Hamdan

[11] Patent Number: 5,503,476

[45] Date of Patent: Apr. 2, 1996

[54] PRE-SORT AND ORGANIZATION LAUNDRY APPARATUS

[76] Inventor: Sharif Hamdan, 923 Cherry Hill Rd., Princeton, N.J. 08540

[21] Appl. No.: 277,842

[22] Filed: Jul. 20, 1994

[51] Int. Cl.[6] ..... B65D 33/14; B65D 30/22

[52] U.S. Cl. ..... 383/9; 383/23; 383/24; 383/26; 383/38; 383/40; 383/86.2

[58] Field of Search ..... 383/9, 14, 24, 383/23, 62, 38, 86.2, 40, 26

[56] References Cited

U.S. PATENT DOCUMENTS

| | | | |
|---|---|---|---|
| D. 294,757 | 3/1988 | Kahane et al. . | |
| D. 308,431 | 6/1990 | Hamper et al. . | |
| D. 336,696 | 6/1993 | Bateman et al. . | |
| 1,496,462 | 6/1924 | Hunt et al. | 383/24 X |
| 1,818,030 | 8/1931 | Arnold | 383/40 |
| 2,078,438 | 4/1937 | Baxter | 383/38 X |
| 2,543,299 | 2/1951 | Pritchard | 383/24 X |
| 2,704,098 | 3/1955 | Pocock | 383/38 X |
| 3,301,295 | 1/1967 | Fitch | 383/9 X |
| 3,309,077 | 3/1967 | Rosenberg et al. | 383/9 |
| 4,094,351 | 6/1978 | Catenaccio | 383/38 X |
| 4,120,335 | 10/1978 | Mitchell | 383/24 X |
| 4,694,503 | 9/1987 | Hydorn | 383/9 X |
| 5,050,998 | 9/1991 | Wachtel . | |

FOREIGN PATENT DOCUMENTS

| | | | |
|---|---|---|---|
| 378478 | 7/1964 | Switzerland | 383/9 |

*Primary Examiner*—Jes F. Pascua

*Attorney, Agent, or Firm*—Mathews, Woodbridge & Collins

[57] ABSTRACT

The present invention relates to an apparatus for presorting laundry having a pair of laundry compartments easily accessible to the user. The apparatus includes a closure panel for closing the compartments. The closure panel includes an aperture in which an object can be received for hanging the laundry apparatus. Alternatively, a hanger can be received in loops attached to the apparatus for allowing the apparatus to be hung over a door knob, laundry cart and the like. The apparatus can include a plurality of pockets for holding various laundry related objects.

8 Claims, 5 Drawing Sheets

PRE-SORT AND ORGANIZATION LAUNDRY APPARATUS

BACKGROUND OF THE INVENTION

1. Field of the Invention

The present invention relates to an apparatus for presorting laundry and organizing related laundry items.

2. Description of the Related Art

Conventional laundry bags typically include a cloth bag and a drawstring closer. The problem of transporting a heavy load in the bag to a washing machine or a laundromat and thereafter separating the white laundry from the colored laundry has persisted for the user.

U.S. Pat. No. 5,123,753 describes a laundry bag with a fastening means to improve transportation of the laundry to the laundromat. A first loop is attached to the exterior of the bag. A second loop is attached on the opposite side of the bag. A strap passes through the first and second loops to close the bag.

U.S. Pat. No. 5,050,998 describes a dual laundry including two or more compartments. Each compartment includes a zipper closure for facilitating discharging of each component individually. The rear panel has a pair of adjustable carrying straps. Grommets are used for hanging the laundry bag. This patent has the shortcoming of requiring a hook or nail for hanging the bag in the grommet and providing limited access to both compartments of the bag.

SUMMARY OF THE INVENTION

Briefly described, the present invention comprises an apparatus for presorting laundry having a pair of laundry compartments. Each of the compartments are accessible from the front of the laundry bag. A hanging means is attached to the apparatus for hanging the bag over an object. Particularly, the hanging means can hang the bag over a doorknob to allow users to expeditiously sort their laundry after undressing. The hanging means can also be used to hang the laundry bag over a bar of a laundry cart at a laundromat. In addition, the hanging means can hang the bag in a closet for keeping a users room neat and the laundry private.

The apparatus can include a plurality of pockets on the outside surface of the apparatus. The pockets can have different sizes for holding various objects. For example, the pockets can be sized to hold laundry detergent, undergarments, magazines, food, change and the like.

The invention will be more fully described with reference to the following drawings.

DETAILED DESCRIPTION OF THE INVENTION

During the course of this description, like numbers will be used to identify like elements according to the different figures which illustrate the invention.

Figure 1A:
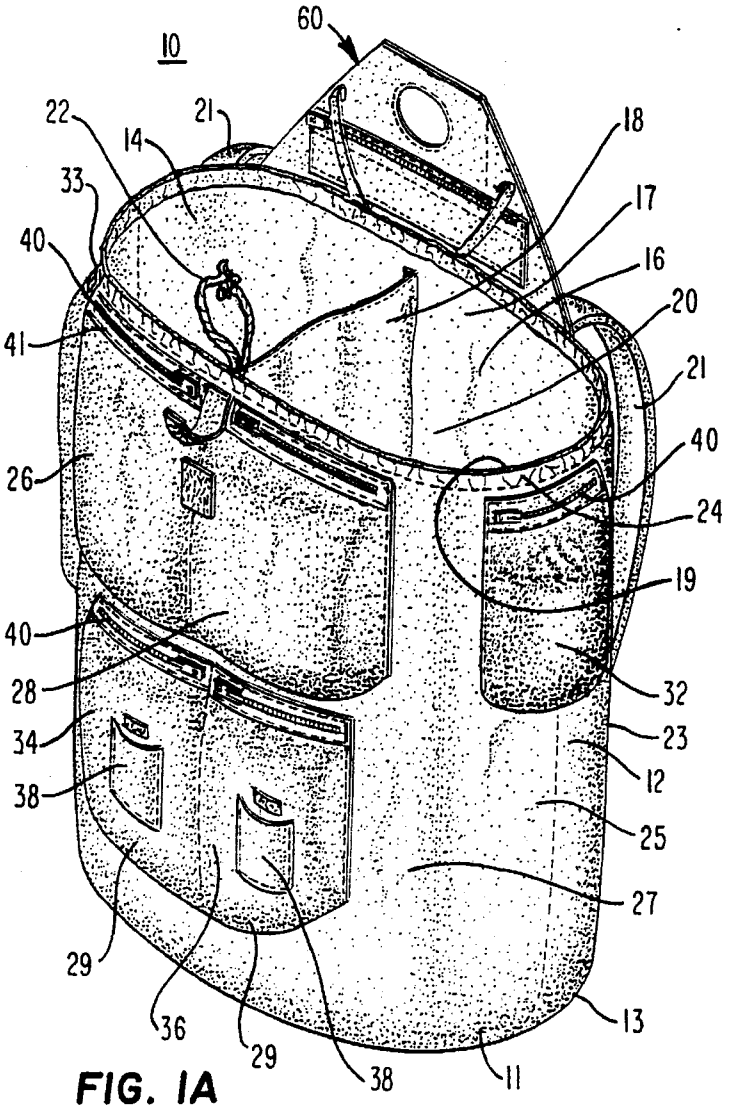
FIG. 1A is an overall perspective view of the laundry pre-sort and organization laundry apparatus of the present invention.
Figure 1B:
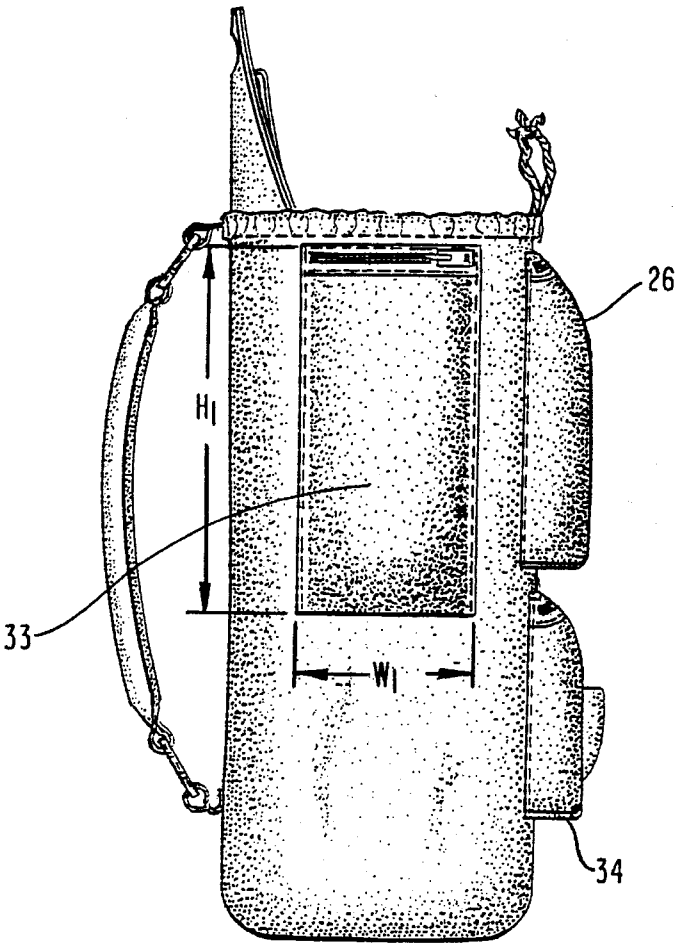
FIG. 1B is a side elevational view of the laundry bag shown in FIG. 1A.

FIGS. 1A and 1B illustrate the pre-sort and organization laundry apparatus 10 of the present invention. Bag 12 has front wall 11 connected to rear wall 13. Separation panel 18 is attached to inside surface 17 of rear wall 13 and inside surface 19 of front wall 11. Separation panel 18 forms compartments 14 and 16 defined by front wall 11 and rear wall 13. Compartments 14 and 16 have an entrance aperture 20 which is adjacent front wall 11 for allowing the user to have easy access to compartments 14 and 16. A drawstring 22 is threaded through hem 24. Drawstring 22 can be drawn for closing aperture 20.

A first pair of pockets 26, 28 and a second pair of pockets 34, 36 are positioned on the outside surface 27 of front wall 11. Pockets 26, 28 can be used for sorting dark and white undergarments such as underwear, colored underwear, bras, socks and the like. Pockets 34 and 36 are preferably used for holding laundry detergent, stain remover, and the like. Side pockets 32, 33 are formed on the outside surface 27 of side surfaces 25. Pouches 38 preferably can be positioned on the outside surface 29 of pockets 34 and 36. A hook loop material 39 can be used to close pouches 38. Preferably, side pocket 33 has a predetermined height $H_1$ and a predetermined width $W_1$ which are sufficient for holding miscellaneous items such as beverages, snacks, magazines, shoes, and the like. Closure member 40 can be attached to the upper end 41 of pockets 26, 28, 30, 33, 34, 36 for closing the pockets. Closure member 40 can be formed of a zipper or an elastic material. Alternatively, closure member 40 can be formed of a hook and loop material such as velcro®. Preferably, zippers are used for closing all pockets in applications needing security of the articles contained in the bag. A secure bag is advantageous in military applications. In military applications, pockets 26, 28, 34, 36 can be used for carrying canteens, compasses, maps, firearms, ammunition, tents, food and the like.

Bag 12 can be formed of a number of types of fabrics such as nylon, leather, burlap, cotton, plastic or denim. Preferably, bag 12 is formed of a light weight washable nylon material.

Figure 2:
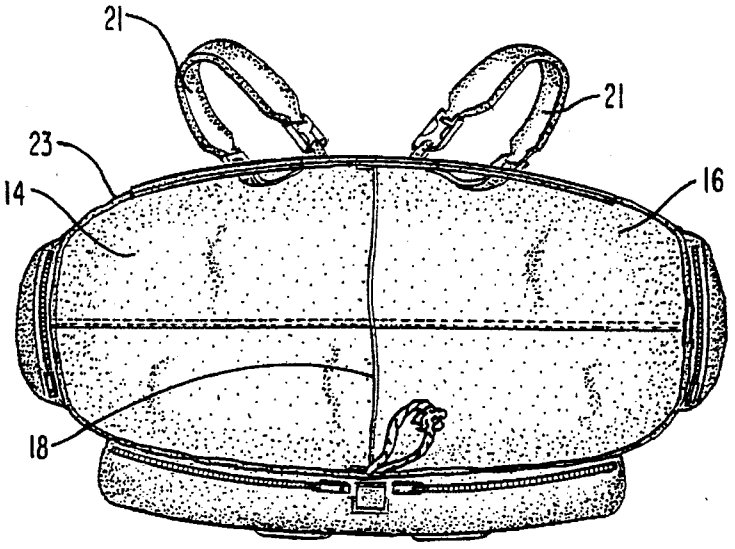
FIG. 2 is a top plan view of the laundry apparatus of FIG. 1.

A pair of straps 21 are attached to the outside surface 23 of rear wall 13 for enabling laundry apparatus 10 to be carried on a user's back, as shown in FIG. 2. Straps 21 can be removable from outside surface 23 for convenience during washing of bag 12.

Figure 3:
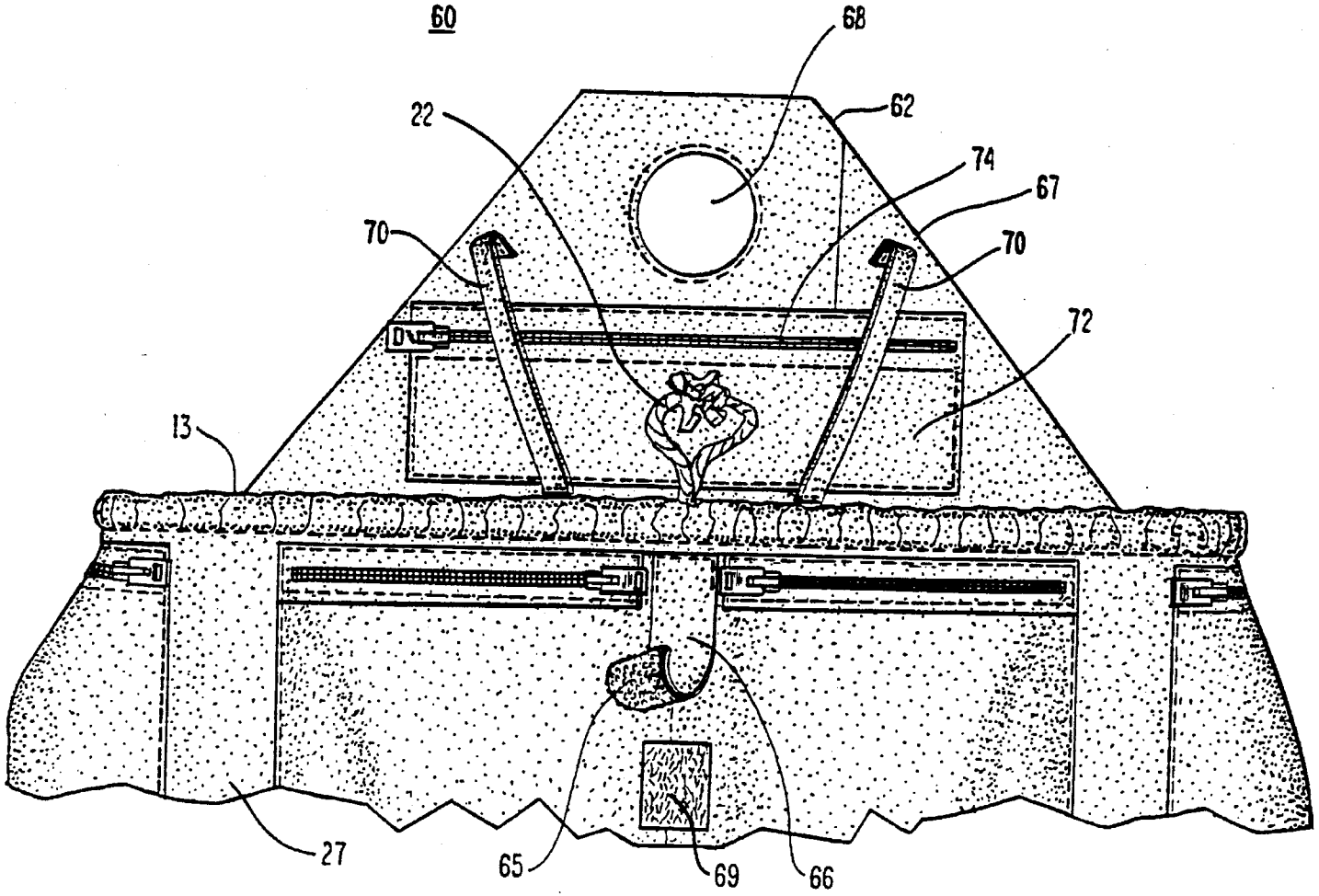
FIG. 3 is a perspective view of the hanging member used in the laundry apparatus.

FIG. 3 is an exploded view of hanging and closure apparatus 60 used with laundry apparatus 10. Rear panel 62 is attached to rear wall 13. Closure strap 66 is attached to outside surface 27 of front wall 11 for closing rear panel 62 over entrance aperture 20 of compartments 14 and 16. Loop members 70 are attached to inner surface 67 of rear panel 62. End 65 of closure strap 66 can include a hook and loop material and can attach to itself after passing through aperture 68. Alternatively, end 65 of closure strap 66 is fed through aperture 68 and attaches to closure member 69 formed of a hook and loop material.

Change purse 72 can be attached to inner surface 67 adjacent loop members 70. Change purse 72 can be closed with closure member 74. Preferably, closure member 74 is a zipper. It will be appreciated that a zipper can be used which can open and close in either direction.

Figure 4A:
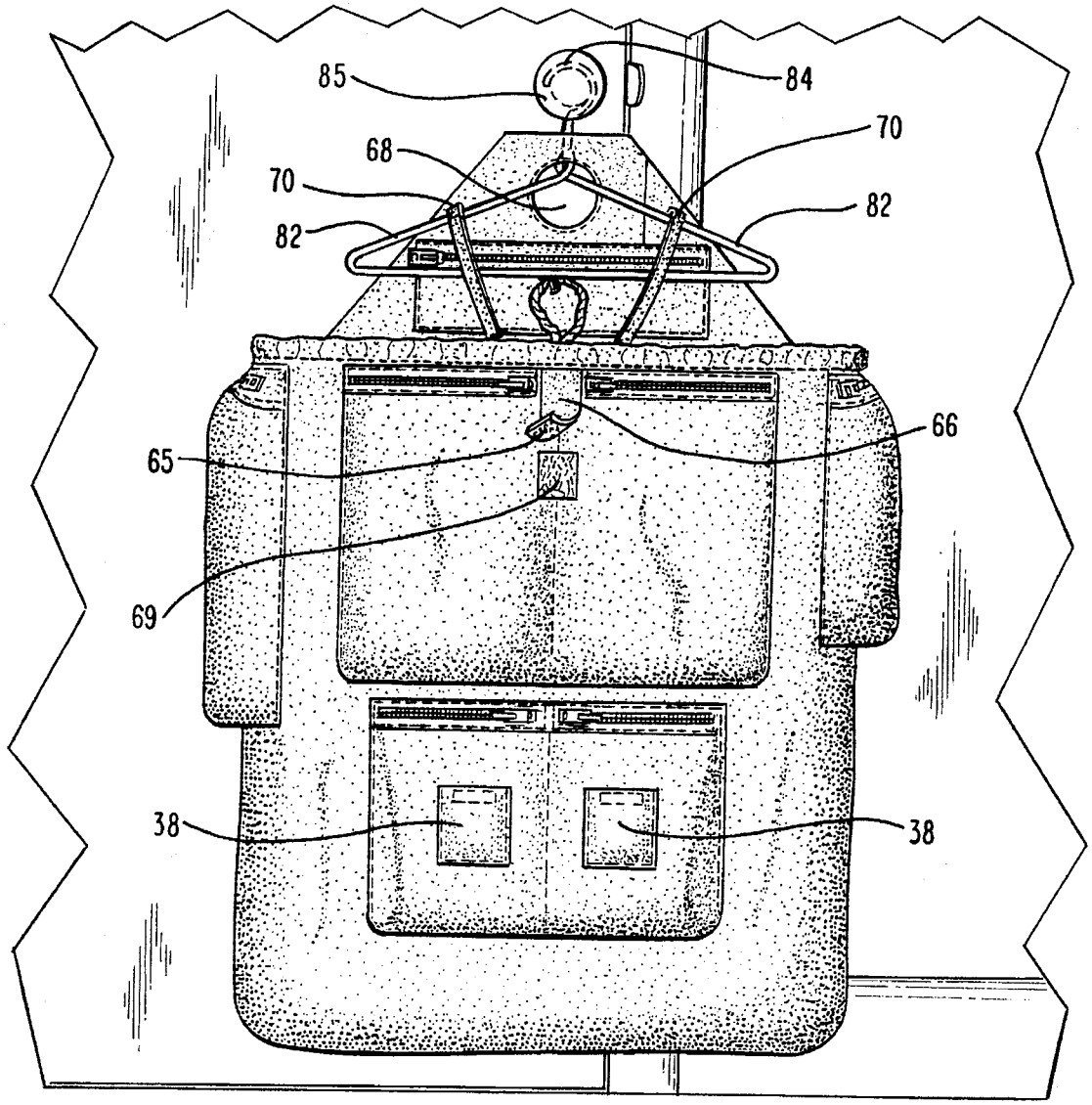
FIG. 4A is a side elevational view of the hanging member used in combination with a hanger.

FIG. 4A illustrates a perspective view of hanging and closure apparatus 60 in combination with an attachment to a door knob. Arms 82 of hanger 80 are received in loop member 70. Hook member 84 of hanger 80 is received in aperture 68. Hook member 84 can hang over knob 85 for hanging laundry apparatus 10 over the knob. For example, the knob can be a door knob, end of a wall hook and the like. The laundry apparatus 10 can hang over the door knob in between laundry trips for receiving clothes after the user undresses. Alternatively, hanger 80 can be hung in a closet for keeping the bag concealed.

Figure 4B:
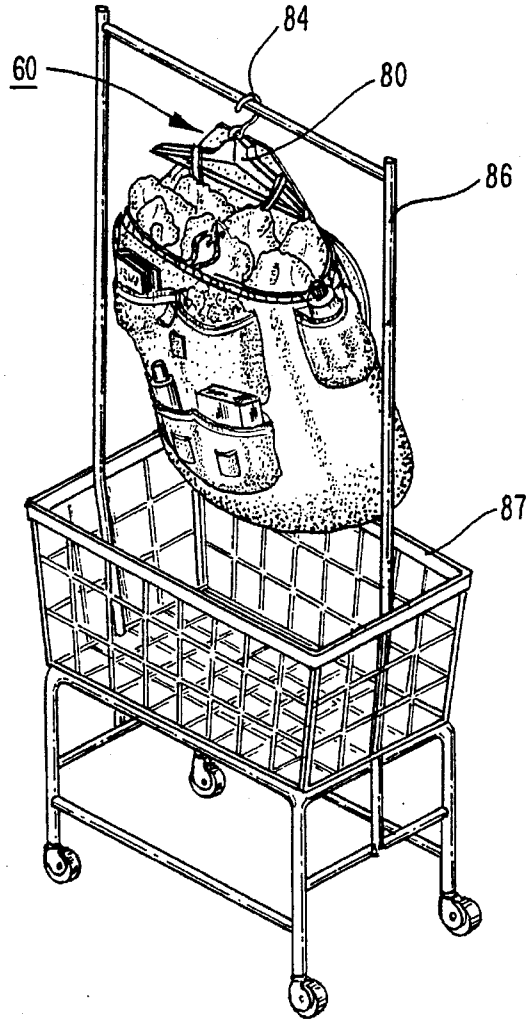
FIG. 4B is a side elevational view of the laundry apparatus hanging on a laundry cart.

FIG. 4B illustrates the hanging and closure apparatus 60 in combination with a laundry cart 87. Hook 84 can hang over bar 86 of laundry cart 87 for attaching hanging laundry apparatus 10 to the laundry cart 87. The laundry apparatus can be hung over the laundry cart for removing soiled clothes from the bag and receiving clean clothes after washing.

Figure 4C:
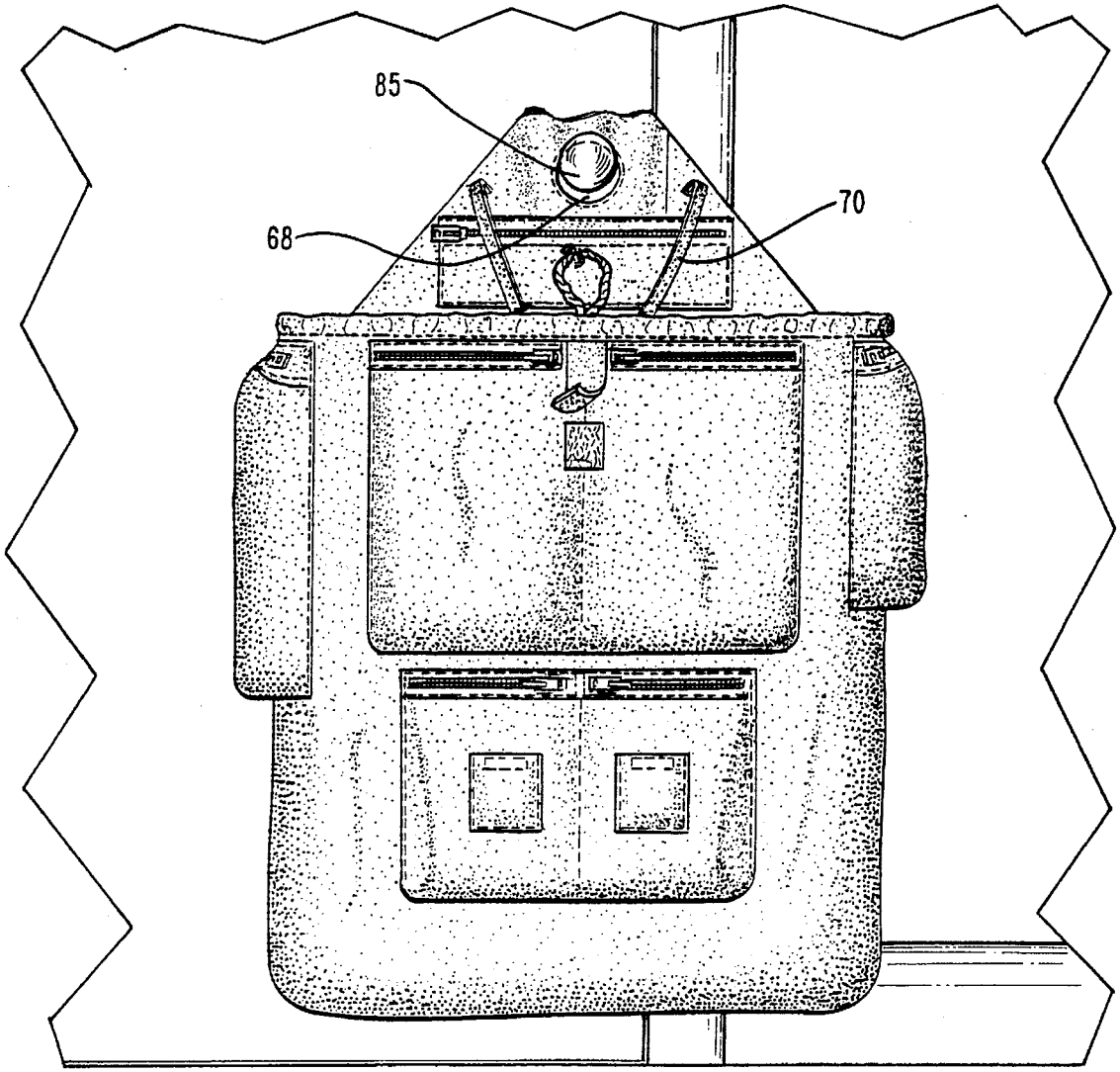
FIG. 4C is a side elevational view of the laundry apparatus hanging on a door knob.

FIG. 4C illustrates an alternative embodiment for attaching hanging and closure apparatus 60 to knob 85. Knob 85 is received in aperture 68.

The present invention has the advantage of providing easy access to two compartments of the bag. Preferably, one compartment can be used to hold white laundry and one compartment can be used to hold colored laundry. Thus, the laundry can be expeditiously sorted into the two compartments. The present invention also has the advantage of providing a hanging means which can be readily used to hang the bag, for example, over a door knob or over a laundry cart. Pockets which are easily accessible are provided of various sizes for organizing laundry related items, holding food, and reading materials and the like. The pockets can be closed with zippers for providing a secure bag. The pockets are easily accessible to the user. The present invention is also useful for sorting laundry for business travellers or campers.

While the invention has been described with reference to the preferred embodiment, this description is not intended to be limiting. It will be appreciated by those of ordinary skill in the art that modifications may be made without departing from the spirit and scope of the invention.

I claim:

1. An apparatus for pre-sorting laundry and for hanging from an object, said apparatus comprising:

a front containing wall, a rear containing wall attached to said front containing wall;

a separation panel extending between said front and said rear containing walls and attached to the inner surface of said front containing wall and said rear containing wall;

first and second compartments respectively defined by said front containing wall, said rear containing wall and said separation panel, said first and second compartments having an entrance aperture, said entrance aperture is adjacent said front containing wall; and, a closure panel attached to said rear wall and a hanging aperture in said closure panel, said closure panel closing said entrance aperture, locking means for locking said closure panel over said first and second compartments, said locking means comprising a closure strap having a first and second end, said first end attached to said front containing wall and said second end having a hook and loop material coupled thereto, wherein said first end of said closure strap is fed through said hanging aperture and said hook and loop material of said second end is attached to itself.

2. The apparatus of claim 1 wherein said object is a doorknob, said apparatus further comprising:

a hanger having a pair of arms, a stem and a hook portion attached to said stem; and, a pair of flexible loops attached to said closure panel, whereby said apparatus may be hung by the arms of said hanger which are received in said pair of flexible loops and said stem of said hanger which is received in said hanging aperture, whereby said hook portion may be received over said doorknob in order to hang said apparatus therefrom.

3. The apparatus of claim 1 wherein said closure panel has an inner and outer surface and further comprising:

a change pocket attached to said inner surface; and a closure means for closing said change pocket.

4. The apparatus of claim 3 wherein said attachment at said front containing wall to said rear containing wall forms a side wall and further comprising:

a plurality of pocket means attached to an outside surface of said front containing wall and said side wall.

5. The apparatus of claim 4 wherein at least one of said pocket means has a height $H_1$ and a width $W_1$ which is of a sufficient size to hold a container for detergent.

6. The apparatus of claim 5 wherein said pocket means comprises two pairs of said pocket means, wherein said first pair of pocket means is positioned above said second pair of pocket means.

7. The apparatus of claim 1 wherein at least one said pair of pocket means includes an outside surface, said apparatus further comprising:

a pouch positioned on the outside surface of at least one of said pair of pocket means.

8. The apparatus of claim 7 wherein said object is a door knob.

* * * * *